US010792950B2

(12) United States Patent
Schilling

(10) Patent No.: US 10,792,950 B2
(45) Date of Patent: Oct. 6, 2020

(54) MULTI-LAYER BODY AND METHOD FOR PRODUCING SAME

(71) Applicant: OVD Kinegram AG, Zug (CH)

(72) Inventor: Andreas Schilling, Hagendorn (CH)

(73) Assignee: OVD KINEGRAM AG, Zug (CH)

( * ) Notice: Subject to any disclaimer, the term of this patent is extended or adjusted under 35 U.S.C. 154(b) by 0 days.

(21) Appl. No.: 15/533,872

(22) PCT Filed: Dec. 10, 2015

(86) PCT No.: PCT/EP2015/079309
§ 371 (c)(1),
(2) Date: Jun. 7, 2017

(87) PCT Pub. No.: WO2016/092040
PCT Pub. Date: Jun. 16, 2016

(65) Prior Publication Data

US 2017/0313121 A1 Nov. 2, 2017

(30) Foreign Application Priority Data

Dec. 10, 2014 (DE) ..... 10 2014 118 366.5

(51) Int. Cl.
*B42D 25/373* (2014.01)
*B42D 25/328* (2014.01)
(Continued)

(52) U.S. Cl.
CPC ..... *B42D 25/373* (2014.10); *B42D 25/23* (2014.10); *B42D 25/24* (2014.10); *B42D 25/29* (2014.10); *B42D 25/324* (2014.10); *B42D 25/328* (2014.10); *B42D 25/364* (2014.10); *B42D 25/378* (2014.10); *B42D 25/41* (2014.10);
(Continued)

(58) Field of Classification Search
CPC ..... B42D 25/328; B42D 25/373
See application file for complete search history.

(56) References Cited

U.S. PATENT DOCUMENTS 5,044,707 A 9/1991 Mallik
5,142,383 A * 8/1992 Mallik ..... G03H 1/02 283/86

(Continued)

FOREIGN PATENT DOCUMENTS

DE 102009032697 10/2010
DE 102012001121 7/2013

(Continued)

*Primary Examiner* — Kyle R Grabowski
(74) *Attorney, Agent, or Firm* — Hoffmann & Baron, LLP

(57) ABSTRACT

The invention relates to a multilayer body with
- a carrier film,
- a partial reflective layer, arranged on the surface of the carrier film, which is at least partially transparent in a first area and opaque in a second area,
- a partial decorative layer, arranged on a surface of the carrier film and/or the side of the decorative layer facing away from the carrier film, which is present in a third area and not present in a fourth area, wherein the first area overlaps the third area and the second area overlaps the third and the fourth areas.
The invention furthermore relates to a method for producing such a multilayer body, a security element with such a multilayer body and a security document with such a security element.

36 Claims, 3 Drawing Sheets

(51) Int. Cl.

| | |
|---|---|
| ***B42D 25/29*** | (2014.01) |
| ***B42D 25/23*** | (2014.01) |
| ***B42D 25/24*** | (2014.01) |
| ***B42D 25/324*** | (2014.01) |
| ***B42D 25/364*** | (2014.01) |
| ***B42D 25/378*** | (2014.01) |
| ***B42D 25/41*** | (2014.01) |
| ***B42D 25/47*** | (2014.01) |
| ***B44C 3/02*** | (2006.01) |
| ***B44F 1/02*** | (2006.01) |

(52) U.S. Cl.
CPC ..... *B42D 25/47* (2014.10); *B44C 3/025* (2013.01); *B44F 1/02* (2013.01)

(56) References Cited

U.S. PATENT DOCUMENTS

| | | | | |
|---|---|---|---|---|
| 5,786,910 | A * | 7/1998 | Walters | G06K 19/18 235/380 |
| 9,251,550 | B2 | 2/2016 | Tierney | |
| 9,321,294 | B2 | 4/2016 | Scheuer | |
| 9,592,701 | B2 | 3/2017 | Fischer et al. | |
| 2002/0030360 | A1 * | 3/2002 | Herrmann | B42D 25/29 283/72 |
| 2007/0183045 | A1 * | 8/2007 | Schilling | B42D 25/29 359/567 |
| 2010/0084851 | A1 * | 4/2010 | Schilling | B32B 15/08 283/91 |
| 2011/0239886 | A1 | 10/2011 | Holmes | |
| 2012/0038988 | A1 | 2/2012 | Staub et al. | |
| 2012/0146323 | A1 | 6/2012 | Schilling et al. | |
| 2014/0002873 | A1 | 1/2014 | Tompkin et al. | |
| 2015/0191027 | A1 | 7/2015 | Springmann | |
| 2015/0192897 | A1 * | 7/2015 | Schilling | G03H 1/0244 359/2 |
| 2015/0224809 | A1 | 8/2015 | Tompkin et al. | |
| 2015/0298482 | A1 * | 10/2015 | Walter | G02B 5/008 359/572 |
| 2016/0110638 | A1 | 4/2016 | Gregarek et al. | |
| 2016/0170219 | A1 | 6/2016 | Fuhse | |

FOREIGN PATENT DOCUMENTS

| | | | | |
|---|---|---|---|---|
| DE | 102012014294 | | 1/2014 | |
| DE | 102012105571 | | 1/2014 | |
| DE | 102012108170 | | 3/2014 | |
| DE | 102012020550 | | 4/2014 | |
| DE | 102012108169 | | 5/2014 | |
| DE | 102012110630 | | 5/2014 | |
| JP | H04212984 | A | 8/1992 | |
| JP | 2007510178 | A | 4/2007 | |
| JP | 2009297931 | A | 12/2009 | |
| JP | 2010517820 | A | 5/2010 | |
| JP | 2010143039 | A | 7/2010 | |
| JP | 2012507039 | A | 3/2012 | |
| JP | 2014199449 | A | 10/2014 | |
| WO | WO2006084686 | | 8/2006 | |
| WO | WO-2014072358 | A1 * | 5/2014 | B42D 25/29 |

* cited by examiner

MULTI-LAYER BODY AND METHOD FOR PRODUCING SAME

This application claims priority based on an International Application filed under the Patent Cooperation Treaty, PCT/EP2015/079309, filed on Dec. 10, 2015, and German Application No. DE 102014118366.5, filed on Dec. 10, 2014.

BACKGROUND OF THE INVENTION

The invention relates to a multilayer body and a method for the production thereof. The invention furthermore relates to a security element with such a mutilayer body as well as a security document with such a security element.

Multilayer bodies are often used as security elements for the protection against forgery and authentication of security documents, banknotes, product packaging and the like. These are systems made up of several layers, for example printed layers, relief structures, reflective layers and the like. In their entirety, these layers form decorative, informative and/or functional motifs and structures, wherein the layers complement each other.

Since the structures of the individual layers interact during the formation of the overall motif, it is important that these structures are applied in register, i.e. in a fixed relative positional relationship with each other. This can, however, often only be realized in a very complex manner in production and increases the manufacturing complexity and the manufacturing costs considerably. At the same time, the register accuracy of several layers relative to each other is an important feature in order to increase the protection against forgery.

By register accuracy is meant a positional accuracy of two or more elements and/or layers relative to each other. The register accuracy should range within a predetermined tolerance and be as low as possible. At the same time, the register accuracy of several elements and/or layers relative to each other is an important feature in order to increase the protection against forgery. The positionally accurate positioning can be effected in particular by means of optically detectable registration marks or register marks. These registration marks or register marks can either represent specific separate elements or areas or layers or themselves be part of the elements or areas or layers to be positioned.

SUMMARY OF THE INVENTION

An object of the present invention is to provide a multilayer body as well as a method for the production thereof, which has an attractive optical appearance combined with simple manufacturing. It is a further object of the present invention to provide optically attractive security elements and security documents on the basis of such multilayer bodies.

Such a mutilayer body comprises:

a carrier film, a partial reflective layer, arranged on the surface of the carrier film, which is at least partially transparent in a first area and opaque in a second area, a partial decorative layer, arranged on a surface of the carrier film and/or the side of the reflective layer facing away from the carrier film, which is present in a third area and not present in a fourth area, wherein the first area overlaps the third area and the second area overlaps the third and the fourth areas.

A method for producing such a multilayer body comprises the steps of:

providing a carrier film, applying a partial reflective layer to the surface of the carrier film, wherein the reflective layer is at least partially transparent in a first area and opaque in a second area, applying a partial decorative layer to a surface of the carrier film and/or the side of the reflective layer facing away from the carrier film, wherein the decorative layer is applied in a third area of the surface and is not applied in a fourth area of the surface, wherein the first area overlaps the third area and the second area overlaps the third and the fourth areas.

A method for producing a security document comprises the steps of:

providing a carrier film with a partial reflective layer, wherein the reflective layer is at least partially transparent in a first area and opaque in a second area, applying a partial decorative layer to a surface of the security document, wherein the decorative layer is applied in a third area of the surface and is not applied in a fourth area of the surface, transferring the partial reflective layer to the decorative layer, with the result that the first area overlaps the third area and the second area overlaps the third and the fourth areas.

A multilayer body obtained in this way can be used as a security element to authenticate security documents such as banknotes, securities, identification documents, driver's licenses, credit cards, passport or visa documents. In addition, purely decorative uses are also conceivable, where the multilayer body would have to function not as a security element but instead only as a visually attractive feature.

A security element can be, for example, a laminating film, an embossing film, an adhesive film or the like, by which the multilayer body can be transferred onto an object. Security strips, security threads, security windows or data pages made of e.g. polycarbonate or the like for integration into documents are also conceivable.

Since the opaque area of the reflective layer overlaps both the third area provided with the decorative layer and the decoration-free fourth area, the opaque second area thus masks the boundary line of the decoration. In other words, both the decorative layer and the reflective layer can be applied with a certain register error, i.e. with a certain positional tolerance or positional inaccuracy relative to each other, which is visually not noticeable due to this masking.

An optically attractive multilayer body is obtained in this way without having to take particular measures in order to ensure a high register accuracy. The production of such a multilayer body is thus considerably simplified and can be carried out with low production costs and a low degree of wastage.

In certain special cases it may even be advantageous to apply the decorative layer over the whole surface, which can be a very cost-effective production method.

By a layer is here meant a planar structure. A layer can be homogeneous or itself in turn have several full-surface or partial, in particular gridded plies. By a grid is meant a sequence of transparent and opaque areas which can be regular or Irregular, in particular stochastic and can also carry additional, in particular non-stochastic information. The opaque areas are grid elements in a wide variety of forms, e.g. grid dots or grid lines or other graphic motifs. Transparent areas are in each case arranged between the grid elements. A grid preferably cannot be resolved by the eye. However, coarser grids are also possible. In particular, attractive continuous transitions between e.g. diffractive metallic areas and printed areas can hereby be created.

By an overlapping of two areas is meant that at least one straight line exists which runs parallel to the surface normals on a visible surface of the multilayer body and intersects both areas.

An opaque area is an area with a transmissivity of less than 30%, preferably of less than 20%, particularly preferably of less than 10%.

A transparent area is an area with a transmissivity of more than 30%, preferably of more than 50%, particularly preferably of more than 70%.

The decorative layer preferably comprises at least one dye, pigment, metal layer, effect pigment, thin-film system, magnetic thin-film system, and/or cholesteric liquid crystal system.

The named components of the decorative layer can also be combined in order thus to obtain complex decorations which are to be imitated only with difficulty and guarantee a high degree of protection against forgery and/or a high level of visual attractiveness.

It is preferred if the third area forms at least one motif, image, symbol, logo and/or alphanumeric character.

In the case of uses for e.g. ID documents, the third area can advantageously also exhibit individualized and/or personalized items of information, such as e.g. names, photo, dates of birth, or the like.

These elements can be present singly, but also in combination and can be purely decorative, but also informative, i.e. for example indicate the denomination of a banknote or the like.

It is furthermore preferred if the decorative layer is or comprises single- or multicolored raster or vector graphics.

In this way particularly attractive decorations can be realized.

Preferably, a layer thickness of the decorative layer is from 5 nm to 500 μm, preferably from 50 nm to 100 μm, particularly preferably from 500 nm to 50 μm.

It is further preferred if the reflective layer is formed at least partially, in particular in the first area, as a metal layer, preferably made of Al, Cr, Cu, Ag, Au or alloys/combinations thereof.

The named metals can also be combined with each other in order thus to realize more complex optical impressions.

In a further embodiment, the first area is formed as a grid of first partial areas, in which the reflective layer is present, and second partial areas, in which the reflective layer is not present.

Although partial areas are therefore present, in which a reflective layer is present in the first area, the first area is still transparent in the meaning of the definition given above due to the arrangement in a grid. Through the arrangement in a grid, further graphic effects can be realized. In particular it is possible for the decorative layer to be visible through the reflective layer in the first area, wherein at the same time a slightly metallic impression forms through the arrangement in a grid.

It is preferred for the grid to be a dot or line grid. However, any desired grids can also be used, e.g. stochastic grids or grids which carry in particular an additional item of non-stochastic information.

The dots or lines of the grid can be arranged regularly, vary according to a predetermined function or also be distributed stochastically. The grid dots of a dot grid can, in the simplest case, be circular, but also have any other geometries. Microstructured items of information such as texts or logos can also be inscribed in the grid dots.

It is furthermore preferred if a grid width of the grid lies below the resolution limit of the human eye and is in particular from 5 μm to 300 μm, preferably from 30 μm to 200 μm.

The grid thus cannot be resolved by the human eye and can only be recognized as an effect superimposed on the decorative layer, for example as a slightly metallic impression (with or without additional diffractive optical effects).

In a further embodiment, the degree of transparency (the ratio of grid aperture to grid width) varies over the first area, preferably according to a predetermined gradient along at least one spatial direction. The grid aperture is in each case the transparent area between two opaque grid elements. The grid width is the distance between two opaque grid elements.

The transparency and/or the metallic impression can hereby be varied in the first area, whereby additional, optically attractive effects can be realized. For example, a continuous or stepwise transition between the transparent and the opaque areas of the reflective layer can hereby be created or a variation of the metallic impression over the grid can be realized.

In particular the combination of a printed color effect with an apparently tactile relief effect is visually very attractive and is eminently suitable as a security feature. The apparently tactile relief effect, e.g. in the form of a free-form surface or lens, can be produced by means of diffractive structures which is formed such that their grating lines essentially follow the outlines of the free-form surface, wherein the distance between the grating lines changes continuously from the central section of the free-form surface outwards to the edge thereof. The effect of an apparently curved free-form surface can however also be produced with statistical variation of certain structural parameters, or also with structures which have a constant distance between the grating lines, but a varying structural depth.

It is furthermore expedient if the first partial areas cover 20% to 80%, preferably 30% to 70%, further preferably 20% to 50% of the surface of the first area.

In the case of such a surface coverage by the reflective layer, the first area still appears substantially transparent to the human eye. A virtually completely opaque-metallic impression first arises in the case of coverage of more than 90%.

In a further embodiment, the decorative layer has at least partially a grid structure which forms a Moiré effect with the grid of the reflective layer.

Additional optical effects can also hereby be produced, which both produce attractive designs and can increase the protection against forgery of the multilayer body.

It is further preferred if the second area completely covers a boundary line between the third and the fourth areas.

The entire outer contour (the outer contour corresponds to the boundary line) of the decorative layer is thus covered by the opaque area of the reflective layer, with the result that any register errors can be concealed over the entire outer contour.

It is particularly preferred if the second area extends, at any point of the boundary lines, perpendicular to the boundary line by in each case a length into the third and the fourth areas, wherein the length at least corresponds in value to a register tolerance occurring when the decorative ply is produced.

If, for example, the register tolerance in one direction or dimension (e.g. only in the X direction or only in the Y direction) is 1 mm (i.e. plus/minus 1 mm), the named length is preferably 1 mm. That is to say the second area is, in this example in one direction or dimension, preferably 2 mm wide and the entire tolerance range of plus/minus 1 mm=2 mm is thus covered by the second area. If the register tolerance moves in two directions simultaneously, that is to say e.g. in the X and Y directions simultaneously, the corresponding register tolerance for one direction from the previous example must be multiplied by 1, i.e. by approx. 1.414. This means that the register tolerance in one direction or dimension (e.g. only in the X direction or only in the Y direction) is for example approximately 1.414 mm (i.e. plus/minus 1.414 mm), i.e. the named length is preferably 1.414 mm. That is to say the second area is, in this example in one direction or dimension, preferably 2.828 mm wide and the entire tolerance range of plus/minus 1.414 mm=2.828 mm is thus covered by the second area.

The described complete concealment of register errors over the entire outer contour of the decorative layer at the same time as minimal surface coverage is hereby achieved by the opaque area. Through the symmetrical extension of the opaque area of the reflective layer along the outer contour, an attractive edge of the visible area of the decorative layer is created at the same time.

This length is expediently 0.2 mm to 2 mm, preferably 0.5 mm to 0.8 mm.

This corresponds to double the register tolerance that occurs in the case of common application methods of the decorative layer, with the result that errors of this type are reliably covered.

In a further embodiment, the reflective layer is formed at least partially, in particular in the second area, as an HRI (HRI=high refractive index) layer, in particular made of ZnS, $TiO_2$, transparent thin-film systems, in particular as an alternating sequence of HRI and LRI (LRI=low refractive index) layers, or also of so-called nanocomposites.

Particularly attractive are combinations of metallic areas, in particular in a gridded transparent area, and HRI layers. Of course, other combinations and distributions are also possible in order to achieve attractive effects.

A layer thickness of the reflective layer is expediently 5 nm to 5000 nm, preferably 20 nm to 100 nm.

It is furthermore advantageous if the multilayer body has or comprises at least one replication layer with a surface relief.

A plurality of further optical effects, in particular of three-dimensional effects, can hereby be produced, which improve the appearance of the multilayer body and increase the protection against forgery. The replication layer can in particular be arranged directly adjacent to the reflective layer such that the reflective layer follows the surface relief and can enhance the optical effects thereof. According to the invention, this first replication layer then lies in front of the decorative layer in the viewing direction. This first replication layer can have, as decoration or optical effect, an Individual motif, in particular in register with other decorative areas, or also an endless pattern which can be out of register or also in register with other decorative areas.

It is further possible to arrange a second replication layer behind the decorative layer in the viewing direction, in particular combined with a second reflective layer. The replication layer is then preferably visible through the transparent areas of the decorative layer and produces a further optically variable effect. In combination with the first replication layer mentioned above and the decorative layer, even more varied optical effects can thus be produced. This second replication layer can have, as decoration or optical effect, an individual motif, in particular in register with other decorative areas, or also an endless pattern which can be out of register or also in register with other decorative areas. In particular the motifs and/or patterns of the first and second replication layers can be in register with each other.

The surface relief preferably comprises one or more relief structures selected from the group diffractive grating, hologram, blazed grating, linear grating, cross grating, hexagonal grating, asymmetrical or symmetrical grating structure, retroreflective structure, microlens, microprism, Fresnel lens structure, free-form Fresnel lens structure, zero-order diffraction structure, moth-eye structure or anisotropic or isotropic mat structure, or a superimposition of two or more of the above-named relief structures.

The grating parameters of the diffractive structures can be constant or vary continuously; can be constant in small partial areas, wherein adjacent partial areas have different grating parameters; or can also be statistically varied. In the case of the named superimpositions, combinations of the variation of the grating parameters are also conceivable, that is to say e.g. a superimposition of a continuously varying structure with a statistically varying structure.

It is furthermore expedient if a layer thickness of the replication layer is from 50 nm to 50 μm, preferably from 200 nm to 1 μm.

The carrier film preferably consists in particular of PET (polyethylene terephthalate), PEN (polyethylene naphthalate) or BOPP (biaxially oriented polypropylene).

The carrier film can, before, during or after application of the multilayer body to an object, for example a security document, be detached from the remaining layers of the multilayer body, which remaining layers of the multilayer body can thus form a transfer ply, which are transferred to the object or substrate. The carrier film protects, and thus stabilizes, the multilayer body before its final attachment, in particular during its production and during transport.

A layer thickness of the carrier film is expediently from 6 μm to 100 μm, preferably from 12 μm to 50 μm.

It is furthermore preferred if the multilayer body comprises a protective layer, in particular made of a UV-curing varnish, of PVC, polyester or an acrylate, which is arranged between the carrier film and the decorative layer.

In contrast to the carrier film, such a protective layer preferably remains on the multilayer body when the latter is applied to an object, and there forms its outer surface. The protective layer can thus protect the sensitive further layers of the multilayer body from environmental influences, dirt, scratches and the like. This additional protective layer can also be provided with a diffractive surface relief. Interesting optical and/or functional effects such as e.g. surfaces with a tactile appearance or dynamic mat gradients can here for example be combined with a logo color and these effects can thus be combined with advantageous properties from the printed area. Such a combined effect, which for example combines diffraction with printing, increases both the visual attractiveness and the protection against forgery.

It is expedient if a layer thickness of the protective layer is from 1 μm to 20 μm, preferably from 3 μm to 10 μm.

In a further embodiment, the multilayer body has a detachment layer, in particular made of a wax layer and/or a strongly filming acrylate, which is arranged between the carrier film and the protective layer.

Such a detachment layer facilitates the simple and damage-free detachment of the carrier film from the transfer ply during application of the multilayer body or transfer ply to an object.

A layer thickness of the detachment layer is expediently from 5 nm to 1 μm, preferably from 10 nm to 1 μm.

Furthermore, the multilayer body preferably has an adhesive layer which is arranged on the side of the reflective layer facing away from the carrier film.

This can be a hot-melt adhesive, a cold adhesive, an optically or thermally activatable adhesive, a UV-activatable adhesive or the like, which allows a fixing of the multilayer body to an object, for example a security document.

A layer thickness of the adhesive layer is expediently from 50 nm to 50 μm, preferably from 0.5 μm to 10 μm.

It has proven advantageous if a further reflective layer is provided in front of the adhesive layer in the viewing direction and thus in particular behind the decorative layer in the viewing direction. It has been shown that, in the case of a dark background of the object or substrate to which the multilayer body is applied, the optical brilliance of the optical effects of the multilayer body can be reduced in some cases. The further reflective layer now serves to shield the optical effects of the multilayer body from the substrate and in particular to highlight them with a surface which does not reduce the brilliance of the optical effects, in particular actually intensifies it, in the viewing direction.

In a preferred embodiment, the decorative layer is applied at least in areas by printing, in particular by screen printing, gravure printing, inkjet printing, die stamping (Intaglio printing) or offset printing.

The named printing processes can also be combined with each other in order for example to produce decorative layers with several printed plies and complex optical effects. In particular, several decorative layers of the same color and/or different colors can be printed accurately in register with each other in order to be able to produce multicolored motifs. The lower the register tolerance, the more precise the motifs that can be produced, which can lead on the one hand to particularly advantageous optical effects and on the other hand to increased protection against forgery.

Alternatively or additionally, the decorative layer can be applied at least in areas by varnishing, casting, dipping and/or metalization. In particular thin-film systems consisting of several layers.

It is furthermore preferred if the reflective layer is applied by sputtering, metalization or gas-phase deposition. Reflective layers with good quality and particularly constant layer thickness can hereby be obtained.

The reflective layer is preferably partially applied.

This can be carried out during application of the reflective layer for example through the use of a mask or a removable partial lacquer layer applied beforehand.

Alternatively, it is also possible for the reflective layer firstly to be applied over the whole surface and subsequently to be structured.

The structuring can be carried out for example by etching. The etching agent is chosen depending on the composition of the reflective layer and only brought into contact with the latter in the areas of the reflective layer to be removed. This can be carried out for example by partial masking of the reflective layer with an etch resist or also by partial printing-on of the etching agent.

BRIEF DESCRIPTION OF THE DRAWINGS

The invention is now explained in more detail with reference to embodiment examples. There are shown in.

DETAILED DESCRIPTION OF THE INVENTION

Figure 1:
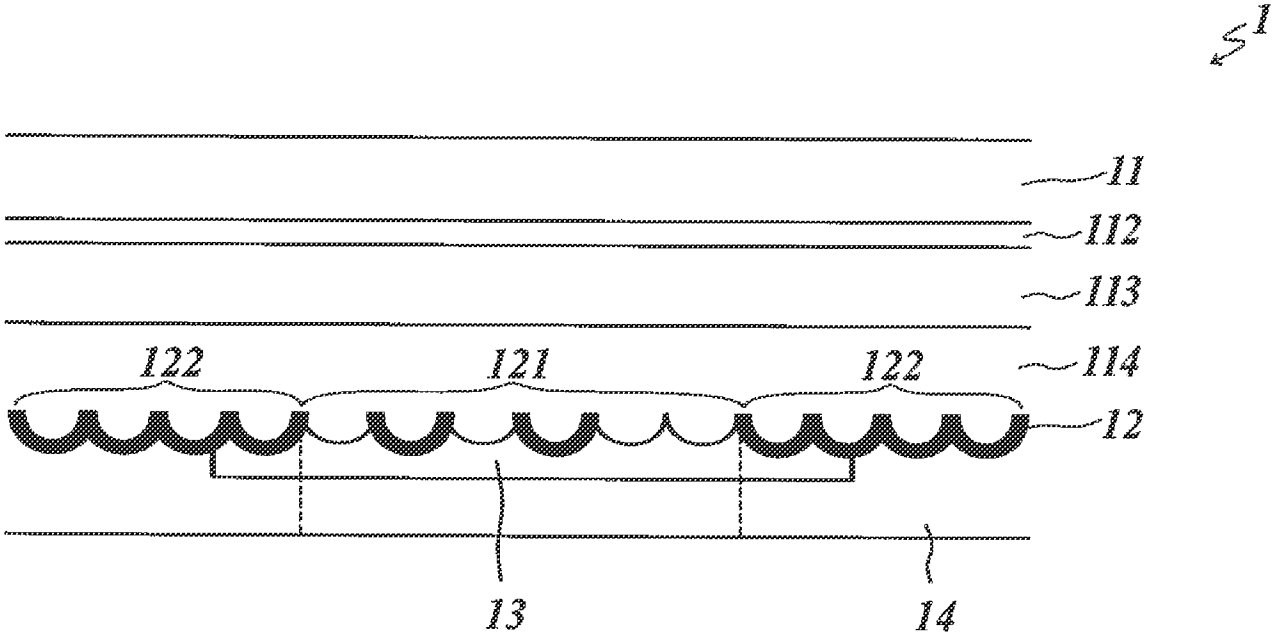
FIG. 1 A schematic sectional representation of an embodiment example of a multilayer body with a decorative layer, a reflective layer and a carrier film with a diffractive surface relief.

A multilayer body labeled as a whole with 1 comprises a carrier film 11, to which a partial metal layer 12 is applied. A partial decorative layer 13 is applied to the side of the metal layer 12 facing away from the carrier film 11, which layer is in turn covered over the whole surface by an adhesive layer 14.

The carrier film 11 has a detachment layer 112, a protective layer 113 and a replication layer 114.

The carrier film 11 preferably consists of PET, PEN or BOPP and preferably has a layer thickness of from 3 μm to 100 μm, particularly preferably from 6 μm to 50 μm.

The detachment layer 112, in particular made of a wax layer and/or a strongly filming acrylate, which is arranged between the carrier film 11 and the protective layer 113, adjoins the carrier film 11.

The detachment layer 112 facilitates the simple and damage-free detachment of the carrier film 11 from the remaining layers of the multilayer body 1 during application of the multilayer body 1 to an object. A layer thickness of the detachment layer is from 5 nm to 1 μm, preferably from 10 nm to 1 μm.

After detachment of the carrier film 11, the protective layer 113 thus forms the surface of the multilayer body 1 accessible from the outside and thus protects the sensitive further layers of the multilayer body from environmental influences, dirt, scratches and the like.

The protective layer 113 preferably consists of a UV-curing varnish, of PVC, polyester or an acrylate and has a layer thickness of from 1 μm to 20 μm, preferably from 3 μm to 10 μm.

The replication layer 114 adjoining the protective layer 113 consists of a replication varnish, preferably of a thermoplastic or UV-curing varnish, with a layer thickness of from 50 nm to 50 μm, preferably from 200 nm to 1 μm.

A surface relief is introduced into the surface of the replication layer 114 facing away from the protective layer 113. This comprises one or more relief structures selected from the group diffractive grating, hologram, blazed grating, linear grating, cross grating, hexagonal grating, asymmetrical or symmetrical grating structure, retroreflective structure, microlens, microprism, Fresnel lens structure, free-form Fresnel lens structure, zero-order diffraction structure, moth-eye structure or anisotropic or isotropic mat structure, or a superimposition of two or more of the above-named relief structures. Complex effects, in particular those which appear to be three-dimensional and can vary depending on the observation direction, can hereby be realized.

The reflective layer 12 is applied to the replication layer 114. This can be formed as a metal layer, preferably made of Al, Cr, Cu. Ag, Au or alloys/combinations thereof.

Alternatively or additionally, the use of highly refractive materials (HRI=high refractive index), in particular of ZnS, $TiO_2$ or also of so-called nanocomposites is also possible. A layer thickness of the reflective layer is preferably from 5 nm to 5000 nm, particularly preferably from 20 nm to 100 nm.

The named materials can also be combined with each other in order thus to realize more complex optical impressions.

The reflective layer 12 has a first area 121 in which it is at least partially transparent, i.e. has a transmissivity of more than 30%. In a second area 122, the reflective layer is opaque, i.e. has a transmissivity of less than 30%.

Figure 2:
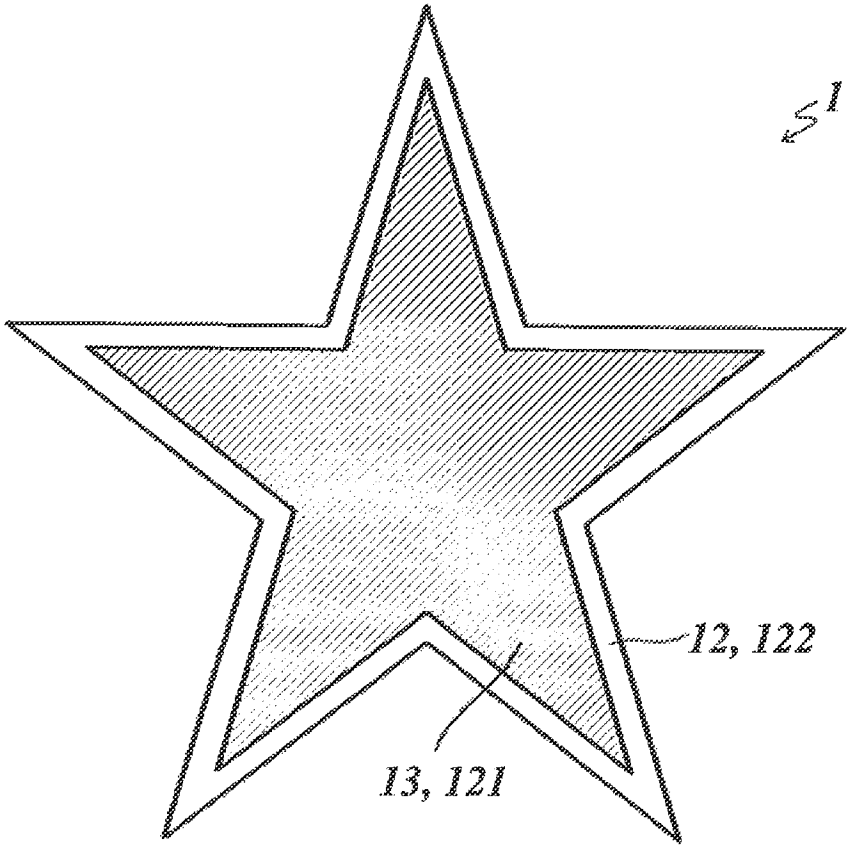
FIG. 2 A schematic top view of an embodiment example of a multilayer body with a decorative layer which is bordered by a continuously opaque metal layer.
Figure 3:
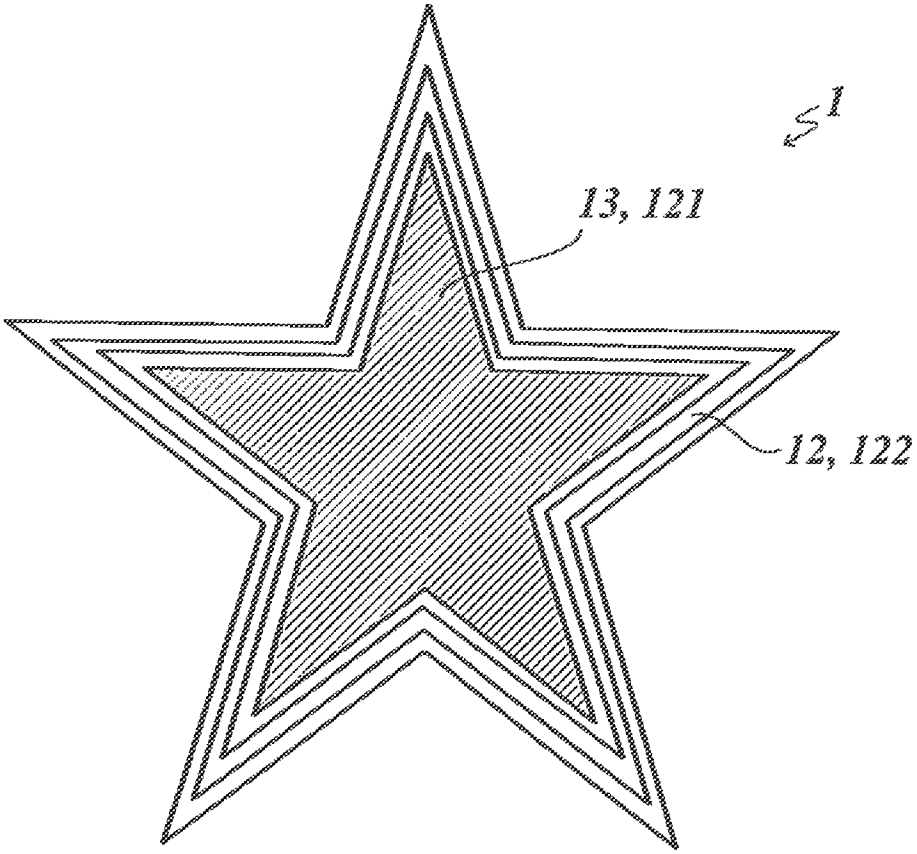
FIG. 3 A schematic top view of an embodiment example of a multilayer body with a decorative layer which is bordered by an opaque metal layer with a diffractive pump effect.

In the examples shown in FIGS. 2 and 3, the first area 121 is formed as a grid of first partial areas, in which the reflective layer is present, and second partial areas, in which the reflective layer is not present.

Although partial areas are therefore present, in which a reflective layer is present in the first area 121, the first area 121 is still transparent in the meaning of the definition given above due to the arrangement in a grid. Through the arrangement in a grid, further graphic effects can be realized. In particular it is possible for the decorative layer 13 to be visible through the reflective layer 12 in the first area, wherein at the same time a slightly metallic impression forms through the arrangement in a grid.

The grid is preferably a dot or line grid. In the examples shown in the figures it is a line grid in the form of hatching.

The dots or lines of the grid can be arranged regularly, vary according to a predetermined function or also be distributed stochastically. The grid dots of a dot grid can, in the simplest case, be circular, but also have any other geometries. Microstructured items of information such as texts or logos can also be inscribed in the grid dots.

A grid width of the grid is preferably below a resolution limit of the human eye and in particular from 5 μm to 300 μm, preferably from 30 μm to 200 μm. The grid thus cannot be resolved by the human eye and can only be recognized as an effect superimposed on the decorative layer 13, for example as a slightly metallic impression.

The grid width can vary over the first area 121, preferably according to a predetermined gradient along at least one spatial direction. For example, a continuous or stepwise transition between the transparent 121 and the opaque areas 122 of the reflective layer 12 can hereby be created or a variation of the metallic impression over the grid can be realized.

The metallic areas of the grid preferably cover 20% to 80%, preferably 30% to 70%, further preferably 20% to 50% of the surface of the first area 121. In the case of such a surface coverage by the reflective layer 12, the first area 121 still appears transparent to the human eye. A completely opaque-metallic impression first arises in the case of coverage of more than 90%.

The coverage of the first area 121 by the reflective layer 12 can vary over the first area 121, preferably according to a predetermined gradient along at least one spatial direction. The transparency and/or the metallic impression can hereby be varied in the first area 121, whereby additional, optically attractive effects can be realized.

The decorative layer 13 is applied to the reflective layer 12. This preferably comprises at least one dye, pigment, metal layer, effect pigment, in particular an optically variable printing ink such as e.g. an OVI®, thin-film system, magnetic thin-film system, and/or cholesteric liquid crystal system. The named components of the decorative layer 13 can also be combined in order thus to obtain complex decorations which are to be imitated only with difficulty and guarantee a high degree of protection against forgery.

It is preferred if the decorative layer forms at least one motif, image, symbol, logo and/or alphanumeric character. These elements can be present singly, but also in combination and can be purely decorative, but also informative, i.e. for example indicate the denomination of a banknote or the like.

Such decorations can be realized for example as single- or multicolored raster or vector graphics.

Suitable processes for producing the decorative layer 13 are printing, in particular screen printing, gravure printing, inkjet printing, die stamping (intaglio printing) or offset printing, but also varnishing, casting, dipping and/or metalization.

The named processes can also be combined with each other in order for example to produce decorative layers with several printed plies and complex optical effects.

A layer thickness of the decorative layer is preferably from 5 nm to 500 μm, preferably from 50 nm to 100 μm, particularly preferably from 500 nm to 50 μm.

The decorative layer 13 covers the transparent area 121 of the reflective layer 12 and extends beyond it into the opaque area 122.

Since the opaque area 122 of the reflective layer 12 thus overlaps both the decorative layer 13 and the decoration-free area of the multilayer body, the opaque area 122 thus masks the boundary line or the outer contour of the decoration. In other words, both the decorative layer 13 and the reflective layer 12 can be applied with a certain register error, i.e. with a certain positional tolerance or positional inaccuracy relative to each other, which does not become noticeable due to this masking.

As FIGS. 2 and 3 show, the opaque area 122 preferably extends along the boundary surface of the decorative layer 13 and covers its boundary line or outer contour.

The entire outer contour of the decorative layer 13 is thus covered by the opaque area 122 of the reflective layer 12, with the result that any register errors can be concealed over the entire outer contour.

It is particularly preferred if the opaque area 122 extends, at any point of these boundary lines, perpendicular to the boundary line by in each case a length away from the boundary line, wherein the length at least corresponds in value to a register tolerance occurring when the decorative ply 13 is produced.

The described complete concealment of register errors over the entire outer contour of the decorative layer 13 at the same time as minimal surface coverage is hereby achieved by the opaque area 122. Through the symmetrical extension of the opaque area 122 of the reflective layer 12 along the outer contour, an attractive edge of the visible area of the decorative layer 13 is created at the same time.

As can be seen in FIG. 3, the opaque area 122 can also be used in combination with the relief structure in the replication layer to produce additional effects. By varying the angle of inclination of micromirrors or the azimuth angle of a blazed grating the tilt effect illustrated schematically in FIG. 3 can for example be achieved, with the result that a reflective zone in the opaque area 122 migrates from the inside outwards or vice versa on tilting the multilayer body 1.

The decorative layer 13 and the reflective layer 12 are finally also covered by the adhesive layer 14, with which the multilayer body 1 can be attached to an object.

This can be a hot-melt adhesive, a cold adhesive, an optically or thermally activatable adhesive or the like. The layer thickness of the adhesive layer is from 50 nm to 50 μm, preferably from 0.5 μm to 10 μm.

LIST OF REFERENCE NUMBERS

1 multilayer body
11 carrier film

112 detachment layer
113 protective layer
114 replication layer
12 reflective layer
121 transparent area
122 opaque area
13 decorative layer
14 adhesive layer

The invention claimed is:

1. A multilayer body comprising:

a carrier film, a partial reflective layer, indirectly arranged relative to the carrier film, the partial reflective layer comprising a first area, in which the partial reflective layer is a at least partially transparent, and a second area in which the partial reflective layer is opaque, the opaque second area forming a frame bounding the partially transparent first area, and a partial decorative layer, arranged relative to the carrier film and/or the side of the partial reflective layer facing away from the carrier film, the partial decorative layer comprising a third area having an outer peripheral contour defined by a boundary line separating the third area in which the partial decorative layer is present and a fourth area in which the partial decorative layer is not present, wherein the partially transparent first area of the partial reflective layer overlaps the third area of the partial reflective layer, and wherein the opaque second area of the partial reflective layer overlaps the third and the fourth areas, with the result that the opaque second area of the partial reflective layer masks the entire boundary line of the partial decorative layer, and wherein a predefined positional tolerance or positional inaccuracy between the partial reflective layer and the partial decorative layer is visually not noticeable due to the masking of the entire boundary line of the partial decorative layer by the partial reflective layer.

2. The multilayer body according to claim 1, wherein the partial decorative layer comprises at least one dye, pigment, metal layer, effect pigment, thin-film system, magnetic thin-film system, and/or cholesteric liquid crystal system.

3. The multilayer body according to claim 1, wherein the third area forms at least one motif, image, symbol, logo and/or alphanumeric character.

4. The multilayer body according to claim 1, wherein a layer thickness of the partial decorative layer is from 5 nm to 500 μm.

5. The multilayer body according to claim 1, wherein the partial reflective layer is formed at least partially in the first area, as a metal layer made of Cu, Ag, Au, Al, Cr or alloys or combinations thereof.

6. The multilayer body according to claim 5, wherein the first area is formed as a grid of first partial areas, in which the partial reflective layer is present, and second partial areas, in which the partial reflective layer is not present.

7. The multilayer body according to claim 6, wherein the grid is a dot or line grid.

8. The multilayer body according to claim 6, wherein a grid width of the grid lies below a resolution limit of the human eye and is from 5 μm to 300 μm.

9. The multilayer body according to claim 1, wherein the frame formed by the opaque second area of the partial reflective layer has a width, wherein the boundary line between the third and the fourth areas is completely covered by the width of the frame.

10. The multilayer body according to claim 9, wherein the width of the frame extends, at any point along the boundary line and perpendicular to the boundary line, by in each case a length into the third and the fourth areas.

11. The multilayer body according to claim 10, wherein the length is 0.2 mm to 2 mm.

12. The multilayer body according to claim 1, wherein the partial reflective layer is formed at least partially in the second area, as an HRI (high refractive index) layer made of ZnS, $TiO_2$ or nanocomposites.

13. The multilayer body according to claim 1, wherein a layer thickness of the partial reflective layer is from 5 nm to 5000 nm.

14. The multilayer body according to claim 1, wherein the multilayer body has or comprises a replication layer with a surface relief.

15. The multilayer body according to claim 14, wherein the surface relief comprises one or more relief structures selected from the group diffractive grating, hologram, blazed grating, linear grating, cross grating, hexagonal grating, asymmetrical or symmetrical grating structure, retroreflective structure, microlens, microprism, Fresnel lens structure, free-form Fresnel lens structure, zero-order diffraction structure, moth-eye structure or anisotropic or isotropic mat structure, or a superimposition of two or more of the above-named relief structures.

16. The multilayer body according to claim 14, wherein a layer thickness of the replication layer is from 50 nm to 50 μm.

17. The multilayer body according to claim 1, wherein the carrier film comprises PET (polyethylene terephthalate), PEN (polyethylene naphthalate) or BOPP (biaxially oriented polypropylene).

18. The multilayer body according to claim 17, wherein a layer thickness of the carrier film is from 6 μm to 100 μm.

19. The multilayer body according to claim 17, wherein the multilayer body comprises a protective layer made of a UV-curing varnish, of PVC, polyester or an acrylate, which is arranged between the carrier film and the decorative layer.

20. The multilayer body according to claim 19, wherein a layer thickness of the protective layer is from 1 μm to 20 μm.

21. The multilayer body according to claim 19, wherein the multilayer body comprises a detachment layer made of a wax layer and/or a strongly filming acrylate, which is arranged between the carrier film and the protective layer.

22. The multilayer body according to claim 21, wherein a layer thickness of the detachment layer is from 5 nm to 1 μm.

23. The multilayer body according to claim 1, wherein the multilayer body has an adhesive layer which is arranged on the side of the partial reflective layer facing away from the carrier film.

24. The multilayer body according to claim 23, wherein a layer thickness of the adhesive layer is from 50 nm to 50 μm.

25. A multilayer body comprising:

a carrier film, a partial reflective layer, arranged on a first side of the carrier film, the partial reflective layer defining an at least partially transparent first area and an opaque second area, the opaque second area forming a frame bounding the partially transparent first area, and a partial decorative layer, arranged on the first side of the carrier film and/or a surface of the partial reflective layer facing away from the carrier film, the partial decorative layer having an outer peripheral contour defined by a boundary line separating a third area in which the partial decorative layer is present and a fourth area in which the partial decorative layer is not present, wherein the partially transparent first area of the partial reflective layer overlaps the third area, and wherein the opaque second area of the partial reflective layer overlaps the third and the fourth areas, with the result that the opaque second area of the partial reflective layer covers the entire boundary line of the partial decorative layer, and wherein the partial reflective layer is formed at least partially in the first area, as a metal layer made of Cu, Ag, Au, Al, Cr or alloys or combinations thereof, and wherein the first area is formed as a grid of first partial areas, in which the partial reflective layer is present, and second partial areas, in which the partial reflective layer is not present, and wherein a grid width of the grid lies below a resolution limit of the human eye and is from 5 μm to 300 μm, and wherein the grid width varies over the first area according to a predetermined gradient along at least one spatial direction.

26. A multilayer body comprising:

a carrier film, a partial reflective layer, arranged on a first side of the carrier film, the partial reflective layer defining an at least partially transparent first area and an opaque second area, the opaque second area forming a frame bounding the partially transparent first area, and a partial decorative layer, arranged on the first side of the carrier film and/or a surface of the partial reflective layer facing away from the carrier film, the partial decorative layer having an outer peripheral contour defined by a boundary line separating a third area in which the partial decorative layer is present and a fourth area in which the partial decorative layer is not present, wherein the partially transparent first area of the partial reflective layer overlaps the third area, and wherein the opaque second area of the partial reflective layer overlaps the third and the fourth areas, with the result that the opaque second area of the partial reflective layer covers the entire boundary line of the partial decorative layer, and wherein the partial reflective layer is formed at least partially in the first area, as a metal layer made of Cu, Ag, Au, Al, Cr or alloys or combinations thereof, and wherein the first area is formed as a grid of first partial areas, in which the partial reflective layer is present, and second partial areas, in which the partial reflective layer is not present, and wherein the first partial areas cover 20% to 80% of the surface of the first area.

27. The multilayer body according to claim 26, wherein the coverage of the first area by the first partial areas varies over the first area according to a predetermined gradient along at least one spatial direction.

28. A method for producing a multilayer body, comprising:

providing a carrier film, applying a partial reflective layer to a first side of the carrier film, wherein the partial reflective layer defines an at least partially transparent first area and an opaque second area, the opaque second area forming a frame bounding the partially transparent first area, applying a partial decorative layer to the first side of the carrier film and/or a surface of the reflective layer facing away from the carrier film, wherein the partial decorative layer has an outer peripheral contour defined by a boundary line separating a third area of the surface in which the partial decorative layer is present and a fourth area of the surface in which the partial decorative layer is not present, and wherein the partially transparent first area of the partial reflective layer overlaps the third area, and wherein the opaque second area of the partial reflective layer overlaps the third and the fourth areas, with the result that the opaque second area of the partial reflective layer masks the boundary line of the partial decorative layer, and wherein the partial decorative layer is applied relative to the partial reflective layer with a predefined positional tolerance or positional inaccuracy, the positional tolerance or positional inaccuracy not being visually noticeable due to the masking of the entire boundary line of the partial decorative layer by the partial reflective layer.

29. The method according to claim 28, wherein the partial decorative layer is applied at least in areas by screen printing, gravure printing, inkjet printing, die stamping or offset printing.

30. The method according to claim 28, wherein the partial decorative layer is applied at least in areas by varnishing, casting, dipping and/or metalization.

31. The method according to claim 28, wherein the partial reflective layer is applied by sputtering, metalization or gas-phase deposition.

32. The method according to claim 28, wherein the partial reflective layer is partially applied.

33. The method according to claim 28, wherein the partial reflective layer is firstly applied over the whole surface and is subsequently structured.

34. A method for producing a security document, comprising:

providing a carrier film with a partial reflective layer, wherein the partial reflective layer defines an at least partially transparent first area and an opaque second area, the opaque second area forming a frame bounding the partially transparent first area, applying a partial decorative layer to a surface of the security document, wherein the partial decorative layer has an outer peripheral contour defined by a boundary line separating a third area of the surface in which the partial decorative layer is present and a fourth area of the surface in which the partial decorative layer is not present, transferring the partial reflective layer to the partial decorative layer, with the result that the partially transparent first area of the partial reflective layer overlaps the third area and, wherein the opaque second area of the partial reflective layer overlaps the third and the fourth areas, with the result that the opaque second area of the partial reflective layer completely covers the boundary line of the partial decorative layer, and wherein the partial decorative layer is applied relative to the partial reflective layer with a predefined positional tolerance or positional inaccuracy, the positional tolerance or positional inaccuracy not being visually noticeable due to the coverage of the entire boundary line of the partial decorative layer by the partial reflective layer.

35. A security element, obtained by transferring the layers of a multilayer body according to claim 1 detached from the carrier film.

36. A security document with a security element according to claim 35.

* * * * *